United States Patent [19]

Berger et al.

[11] 4,083,453

[45] Apr. 11, 1978

[54] TRAY WITH IDENTIFICATION MEANS

[76] Inventors: Patricia L. Berger, S. 65, W. 12697 Byron Rd., Hales Corners, Wis. 53130; Ida Podhora, 1244 N. 68th St., Apt. No. 208, Wauwatosa, Wis. 53213

[21] Appl. No.: 762,143

[22] Filed: Jan. 24, 1977

[51] Int. Cl.[2] ..... B65D 1/34; B65D 1/00; G09F 3/00

[52] U.S. Cl. ..... 206/565; 206/564

[58] Field of Search ..... 206/557, 564, 565, 459, 206/518, 823; 229/2.5; 40/324

[56] References Cited

U.S. PATENT DOCUMENTS

| | | | |
|---|---|---|---|
| 1,711,412 | 4/1929 | Hines | 206/823X |
| 3,442,378 | 5/1969 | Wolfe | 206/565 X |

*Primary Examiner*—George T. Hall
*Attorney, Agent, or Firm*—Robert J. Steininger

[57] ABSTRACT

A tray with an identification device integral with the base of the tray. The device is formed with an arcuate slot for receiving flexible identification material and is designed to be nestable with a similar device on a second tray to allow stacking.

10 Claims, 5 Drawing Figures

TRAY WITH IDENTIFICATION MEANS

BACKGROUND OF THE INVENTION

This invention relates generally to improvements in the art of identifying trays designed to convey items which are specifically selected, and more particularly to improvements in food serving trays for use in hospitals and similar institutions where unique means must be related to previously designated persons.

Prior to this invention, a common means of identifying trays used in assembling and delivering food in hospitals and similar institutions has been to employ a separate device labeled with a card or paper slip and set in the tray. This arrangement offered an opportunity for those served to remove the devices from the tray and had the obvious disadvantage of making possible shifts of the device from tray to tray giving rise to errors in delivery.

To avoid the problems of loss of separate identification holders and the inherent possiblity of placement of such holders in the wrong tray, numerous means for fixing an identifying means to a tray have been devised. U.S. Pat. No. 1,826,037 to Allen provides such a device. However, attachment of that device to a tray made stacking and handling difficult and introduced cleaning problems. U.S. Pat. No. 2,891,695 to Peters provides a somewhat similar device which projects upwardly along an entire side of the tray. The tray is nestable with similar trays but the projected side substantially increases weight and complexity of the tray while retaining the cleaning problem. U.S. Pat. No. 3,442,378 to Wolfe incorporates similar cleaning difficulties in that the identification holder involves areas in which microorganisms can develop relatively free from being dislodged by the flow of cleaning fluids.

Accordingly, this invention is directed to solving the cleaning and stacking problems in the prior art while retaining the features of a simple tray with identification means fixed integrally with the tray and which is capable of firmly holding a replaceable label or identification.

SUMMARY OF THE INVENTION

This invention involves an easily constructed tray which combines a simple means for conveying items selected for delivery to a particular person or location with a device for identifying the tray. The identification device is integral with the base of the tray and is equipped with an arcuate slot for receiving flexible identification material. This device functions to deform the flexible material into an arcuate configuration thus imparting an increased degree of rigidity which causes such material to stand upright at a predetermined angle for easy viewing.

The slot is open to allow cleaning materials to flow through and the device is designed to be nestable with a similar device on a second tray to allow stacking in the same manner as is experienced by simple trays with no special means for holding identification material.

BRIEF DESCRIPTION OF THE DRAWINGS

The advantages of this invention will be apparent to a person skilled in the art of serving trays and other material collecting and handling devices, from a reading of the detailed description which follows in conjunction with the accompanying drawings wherein similar reference characters refer to similar parts and in which.

DETAILED DESCRIPTION

Figure 1:
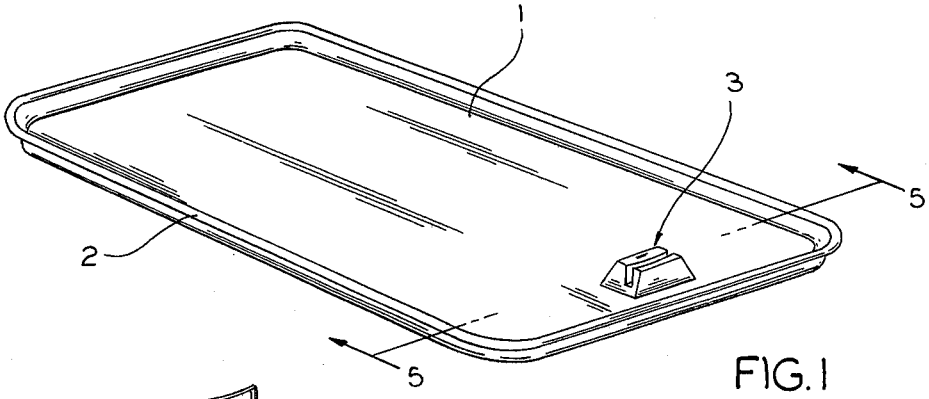
FIG. 1 is a top perspective view of the tray and of the identification device.

While the invention as shown in the accompanying drawings and as hereinafter described is especially adapted for hospital use, the specific improvements embodied in the combination of an identifying means with a means for accumulating and conveying selected objects are applicable to a variety of other devices designed to perform accumulating and conveying functions.

Referring to the drawings, the improved tray disclosed therein generally comprises a relatively flat rectangular base 1 constructed from a rigid material to provide support for items carried in the tray and having an upwardly directed edge 2 extending along each of its sides.

Located on said base 1 in spaced relation to said edge 2 is identification device 3 with sides 4 and 5, ends 6 and 7 and top 8 constructed of the same material as base 1, each such side and each such end being integral with and extending upwardly from the corresponding side or end of an opening in said base 1.

Figure 2:
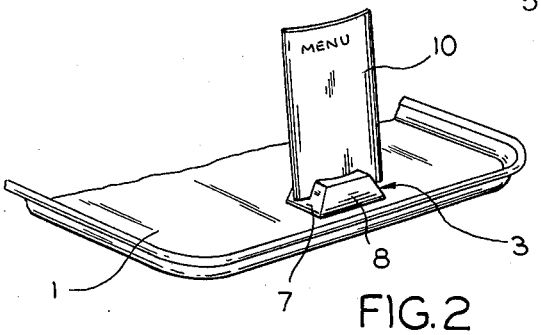
FIG. 2 is a fragmentary top perspective view of the end of the tray carrying the identification device in which flexible identification material is inserted.
Figure 3:
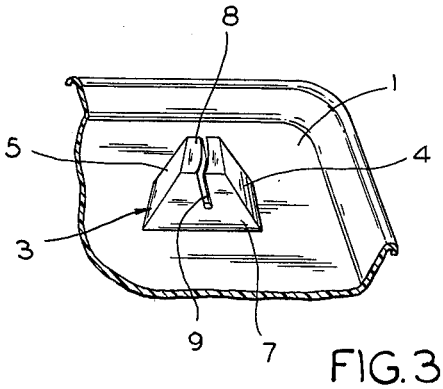
FIG. 3 is a fragmentary top perspective view of the enlarged identification device.

Narrow arcuate slot 9 passes through side 6, top 8 and side 7 such that the lower portion of sides 6 and 7 are not penetrated (see FIG. 3), thus retaining the fluid containing characteristic of the tray while providing a narrow curved form for receiving an end of flexible insert 10 on which identification information is carried. See FIG. 2.

Figure 4:
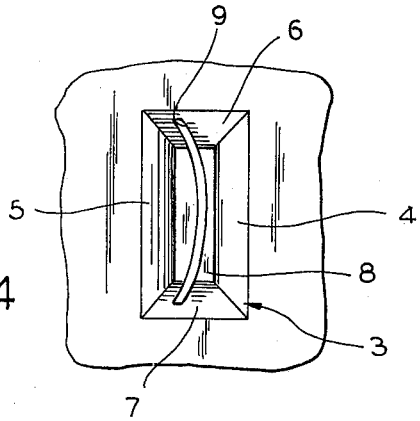
FIG. 4 is a fragmentary bottom plan view of the enlarged identification device.
Figure 5:
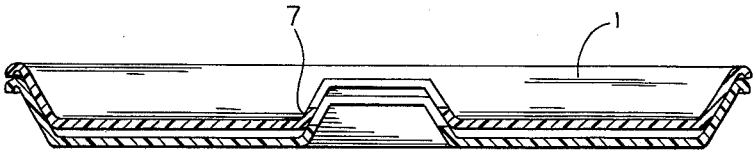
FIG. 5 is a cross sectional view of a pair of stacked trays taken along the lines 5 — 5 of FIG. 1.

An important characteristic of identification device 3 is the interior construction shown in FIG. 4. Since the walls of the sides, ends and top of such device correspond in thickness to that of base 1, when two identical trays are stacked as shown in FIG. 5, the trays are nestable such that the bottom of each of base 1, sides 4 and 5, ends 6 and 7 and top 8 of the first tray rests in a closely proximate relationship to the top of the respective part of a second tray to facilitate storing such trays in a minimum of space.

A common application of the invention is in the dietary service operation of large hospitals and similar institutions. Many specific menus are prepared and served, each for a single patient, and such preparation is repeated at frequent intervals. Speed in selecting menu items is essential, but accuracy cannot be sacrificed to speed up the process. The tray provided by this invention is designed so that a menu carried on flexible material is inserted in slot 9 and, due to the arcuate configuration of such slot 9, is held erect at a selected angle with the horizontal so that it can be easily read by dietary personnel as the tray moves along during the loading process. When properly loaded the flexible material 10, securely held by the slot configuration, serves to direct the tray to a specific patient where it adequately functions to hold any spilled liquid.

Following return of the tray to the dishwashing process the flexible material is easily removed and the tray can be thoroughly washed since cleaning solvents easily penetrate into the interior of identification device 3. Because of the curved construction of slot 9, such slot can be of adequate width to allow such penetration yet function adequately to hold flexible material erect.

Following cleaning, trays can be nested because of the substantial extent to which identification device 3 fits within a similar device on another tray, and substantial storage space is therefore saved.

In addition to use in hospital dietary service, the tray has wide application in a variety of situations where items are selectively collected from stores and move to a location where operations involving the collected items are performed. All of the characteristics of an identification device which readily receives flexible material carrying information, holding such information in a clearly visible position, rapid removal of such flexible material and easy cleaning and storage apply to fast food service, order filling and a variety of automated manufacturing processes.

The invention has proven adequate to perform all of the above described functions and, because of the uniform thickness of base 1 and the sides, ends and top of the identification device 3, production of the tray and such identification device from common material substantially reduces manufacturing complication.

It should be understood that it is not desired to limit this invention to the exact details of construction or to the enumerated modes of use herein shown and described, but rather it is contemplated that various modifications of construction and application within the scope of the appended claims are intended to be encompassed by the foregoing drawings and description.

Having thus described my invention, what I claim as new and desire to secure by Letters Patent of the United States is:

1. In a tray with component parts nestable with corresponding parts of a similar tray, the combination of:

a rigid flat base;

edges upwardly extending from the sides and ends of such base, and an identification device spaced from said edges extending upwardly from such base and having a slot comprising an opening in said base for receiving a flexible insert.

2. In a tray as described in claim 1 in which said slot and said insert are adjacent a cylindrical plane in which said insert is rigidly held at a predetermined angle from the horizontal.

3. In a tray as described in claim 1 in which said identification device is located substantially adjacent one edge of such base.

4. In a tray as described in claim 3 in which said identification device is integral with such base and comprises two sides and two ends projecting above said base and terminating at a top positioned in a plane above and parallel with said base.

5. In a tray as described in claim 4 in which said slot forms a curved opening across the length of said top and extends a predetermined distance from said top into each of said ends.

6. In a tray as described in claim 5 in which the opening extending into each of said ends forms a predetermined angle from a plane perpendicular to said base.

7. In a tray as described in claim 1 in which the bottom of said identification device defines an opening in said base.

8. In a tray as described in claim 7 in which said identification device comprises two sides and two ends projecting above said base and terminating at a top and in which said slot comprises a curved opening extending across said top and into each such end to a point on a horizontal plane adjacent the top of such edges.

9. In a tray described in claim 8 in which the dimensions of such opening in said base are greater than the corresponding dimensions of said top.

10. In a tray described in claim 2 in which the bottom of said identification device defines an opening in said base and the sides and ends of said identification device project from and are integral with the corresponding sides and ends of said opening.

* * * * *